US005808253A

United States Patent [19]

Hatakeyama

[11] Patent Number: 5,808,253

[45] Date of Patent: Sep. 15, 1998

[54] CIRCUIT-BREAKING APPARATUS

[75] Inventor: Shunichi Hatakeyama, Saitama, Japan

[73] Assignee: Fuji Electric Co., Ltd., Kawasaki, Japan

[21] Appl. No.: 626,379

[22] Filed: Apr. 2, 1996

[30] Foreign Application Priority Data

Apr. 6, 1995 [JP] Japan ..... 7-080962

[51] Int. Cl.[6] ..... H01H 35/00

[52] U.S. Cl. ..... 200/61.08; 102/263; 337/409

[58] Field of Search ..... 89/1.14, 1.15; 102/217, 263, 202.5, 202.9; 175/4.54, 4.56; 200/1 R, 17 R, 52 R, 61.08, 400, 300, 82 R, 83 R, 83 N; 337/401, 6, 407–409, 413

[56] References Cited

U.S. PATENT DOCUMENTS

| | | | |
|---|---|---|---|
| 2,816,196 | 12/1957 | Daudelin | 200/142 |
| 3,264,438 | 8/1966 | Gay | 200/142 |
| 3,641,289 | 2/1972 | Dokopoulos | 200/61.08 |
| 4,339,638 | 7/1982 | Lascelles et al. | 200/52 R |
| 4,385,216 | 5/1983 | Cinquin | 200/61.08 |
| 4,490,707 | 12/1984 | O'Leary | 337/6 |
| 4,852,494 | 8/1989 | Williams | 102/263 |

FOREIGN PATENT DOCUMENTS 45-28139 9/1970 Japan .

*Primary Examiner*—Cassandra C. Spyrou
*Assistant Examiner*—Michael A. Friedhofer
*Attorney, Agent, or Firm*—Kanesaka & Takeuchi

[57] ABSTRACT

A circuit-breaking apparatus is formed of an insulating housing, first and second electrodes located at both ends of the insulating housing, a detonator located in the first electrode, a lead connected to the detonator for supplying an electric current to the detonator when the detonator is actuated, and a conductor disposed in the insulating housing. The conductor includes a fixed portion electrically connected to the first electrode, a circuit-breaking rod having narrow portions at both ends, and a barrel connected to the second electrode and having a cavity. The circuit-breaking rod is coupled to the fixed portion and the barrel through the narrow portions. The barrel has a locking section for locking in the cavity the circuit-breaking rod that has been shifted toward the second electrode due to cutoff of the narrow portions caused by the explosion of the detonator. Accordingly, the circuit-breaking function is surely maintained, and it can be easily determined whether a circuit-breaking operation has been performed.

10 Claims, 6 Drawing Sheets

CIRCUIT-BREAKING APPARATUS

BACKGROUND OF THE INVENTION AND RELATED ART STATEMENT

The present invention relates to a circuit-breaking apparatus for interrupting or cutting an electric current by using explosive power of an explosive, and in particular, to a circuit-breaking apparatus that is operated in an emergency situation so as to interrupt or cut an electric current from a battery in an electric car in which an AC motor for driving the wheels is used via an inverter while using the battery as a power source.

FIG. 7 is an explanatory drawing showing a driving system for an electric car, and FIG. 8 shows a circuit for the driving system. In these figures, a driving battery is formed of a front battery 110 and a rear battery 120, each of which is composed of a required number of unit cells 100 connected together in series. The front battery 110 is located in a front portion of the car, while the rear battery 120 is located in a rear portion. DC power supplied from the driving battery is converted into AC power by an inverter 4, which is then supplied to an AC motor 5. A protection fuse 3 is used to protect a circuit as required. A main switch 2 electrically connects or separates between the driving battery and the inverter 4. A shaft of the AC motor 5 is connected to a differential gear 7 via a speed reducer or gears 6 to drive wheels 81, 82. Due to weight and installation space of the battery, the driving battery is divided into the front battery 110 located in the front portion of an electric car 10 and the rear battery 120 located in the rear portion.

The front battery 110 and the rear battery 120 are equipped at the terminals with circuit-breaking apparatuses 901, 902, 903, 904, respectively, in which electric current can be interrupted or cut by explosive power of an explosive. Circuit-breaking time of these circuit-breaking apparatuses 901, 902, 903, 904 is controlled by a controller 400. That is, the controller 400 has a built-in impact detection device for detecting an accident-related impact and operating the circuit-breaking apparatuses 901, 902, 903, 904 to interrupt the electric current near the terminals of the front and rear batteries 110 and 120 in order to prevent any secondary accident, such as fire caused by short circuit after an accident.

A circuit-breaking apparatus that interrupts an electric current by using explosive power of an explosive is used in other field, for example Japanese Patent Publication (KOKOKU) No. 45-28139. In such a circuit-breaking apparatus, a circuit-breaking rod is provided in a conductor in the apparatus via narrow portions, and an electric current normally flows through the circuit-breaking rod via the narrow portions. At the time of circuit-breaking, the narrow portions are cut by explosive power of an explosive, and the circuit-breaking rod shifts to thereby interrupt or cut an electric current path in the apparatus and the electric current.

In the electric car, the circuit-breaking apparatuses 901, 902, 903, 904 perform a circuit-breaking operation in an accident as described above, and the major object of this operation is in particular to protect the passengers' life. The reliability of the circuit-breaking operation is particularly required. Possibilities of failures to break or cut off the circuit or electricity, such as returning of the circuit-breaking rod to its original position, failure of cutting or extinguishing arc generated when the circuit-breaking rod is shifted due to a high voltage applied to the circuit-breaking apparatus at the time of circuit-breaking, or re-ignition of an arc that has been cut off, must be avoided as much as possible in order to have stable circuit-breaking performance. However, the conventional circuit-breaking apparatuses are not always satisfactory in this regard. Also, the circuit-breaking apparatus that has performed a circuit-breaking operation can not be reused and must be replaced by a new product, but it is not easy to determine whether a circuit-breaking operation has been performed from an external inspection.

An object of the invention is to provide a circuit-breaking apparatus capable of reliably maintaining a circuit-breaking condition after an actual circuit-breaking operation.

Another object of the invention is to provide a circuit-breaking apparatus as stated above, wherein the apparatus is capable of preventing a failure during a circuit-breaking operation.

A further object of the invention is to provide a circuit-breaking apparatus as stated above, wherein the apparatus can easily determine whether or not a circuit-breaking operation has been performed.

SUMMARY OF THE INVENTION

To meet the above objects, in a first aspect of the invention, a circuit-breaking apparatus comprises an insulating cylinder; first and second electrodes located at the respective ends of the insulating cylinder; a detonator located at a side of the first electrode, in which an explosive is housed; a lead connected to the detonator from an exterior of the first electrode, which supplies an electric current to the detonator; and a conductor having a fixed portion fixed to the first electrode, a circuit-breaking rod and a barrel section, which are arranged linearly. The circuit-breaking rod is coupled to both the fixed portion and the barrel section via narrow portions. The barrel section is fixed to the second electrode, and has a cavity for receiving the circuit-breaking rod therein. In the invention, the barrel section has a locking section for locking the circuit-breaking rod that has been shifted to the second electrode due to cutoff of the narrow portions caused by explosion of the detonator.

In a second aspect of the circuit-breaking apparatus of the invention, the locking section of the barrel section is a large-diameter portion attached to the second electrode, wherein a part of the circuit-breaking rod that has been shifted to the second electrode due to the explosion of the detonator is plastically deformed by its collision against the second electrode and locked to the large-diameter portion.

In a third aspect of the invention, a circuit-breaking apparatus according to the invention comprises an insulating cylinder; first and second electrodes located at the respective ends of the insulating cylinder; a detonator located at a side of the first electrode, in which an explosive is housed; a lead connected to the detonator from an exterior of the first electrode, which supplies an electric current to the detonator; and a conductor having a fixed portion electrically connected to the first electrode, a circuit-breaking rod, and a barrel section, which are arranged linearly. The circuit-breaking rod is coupled to both the fixed portion and the barrel section via narrow portions. Also, the barrel section is fixed to the second electrode, and has a cavity for receiving the circuit-breaking rod therein. The barrel section has a locking section for locking the circuit-breaking rod that has been shifted to the second electrode due to cutoff of the narrow portion caused by explosion of the detonator.

In the invention, an arc-extinguishing insulating cylinder formed of a material that generates gas when subjected to an arc, or an arc-extinguishing material is provided near the narrow portion for connecting the breaking rod and the fixed portion together and exposed to the arc.

In a fourth aspect of the invention, a circuit-breaking apparatus of the invention comprises an insulating cylinder; first and second electrodes located at the respective ends of the insulating cylinder; a detonator located at a side of the first electrode, in which an explosive is housed; a lead connected to the detonator from an exterior of the first electrode, which supplies an electric current to the detonator; and a conductor having a fixed portion electrically connected to the first electrode, a circuit-breaking rod, and a barrel section, which are arranged linearly. The circuit-breaking rod is coupled to both the fixed portion and the barrel section via narrow portions. The barrel section is fixed to the second electrode, and has a cavity for receiving the circuit-breaking rod therein. In the invention, the barrel section has a locking section for locking the circuit-breaking rod that has been shifted to the second electrode due to cutoff of the narrow portions caused by the explosion of the detonator. Also, an operation-indicating rod, which has one end pressed by the circuit-breaking rod moving to the second electrode and the other end protruding to the exterior of the second electrode when the detonator is exploded, is press-fitted in and engaged with the second electrode.

In a fifth aspect of the circuit-breaking apparatus according to the invention, the distance over which the circuit-breaking rod moves until it contacts the operation-indicating rod is larger than the distance required to insulate the circuit-breaking rod from the first electrode.

According to the first aspect of the circuit-breaking apparatus of the invention, the circuit-breaking rod that has been shifted to the second electrode due to the cutoff of the narrow portions caused by the explosion of the detonator is reliably locked to the locking section of the barrel section. In the second aspect, a part of the circuit-breaking rod that has been shifted to the second electrode due to the explosion of the detonator is plastically deformed by the collision against the second electrode and locked to the locking section of the barrel section.

In the third aspect of the circuit-breaking apparatus, gas is; generated at the time of the circuit-breaking or cutting a current, because the arc-extinguishing insulating cylinder is subjected to an arc generated between the fixed portion and the circuit-breaking rod that has been cut off from the fixed portion. In the circuit-breaking apparatus of the invention, the arc-extinguishing material generates gas at the time of circuit-breaking or cutting a current, because it is subjected to an arc generated between the fixed portion and the circuit-breaking rod that has been cut off from the fixed portion.

According to the fourth aspect of the circuit-breaking apparatus, when the detonator is exploded, one end of the operation-indicating rod provided in the second electrode is pushed by the circuit-breaking rod shifting to the second electrode, and the other end protrudes outwardly from the second electrode. In addition, when the operation-indicating rod is manufactured by press-fitting in the second electrode, the operation-indicating rod is prevented from being moved easily either before or after the circuit-breaking operation.

In the invention, the operation-indicating rod starts to move after the insulation distance has been established between the first electrode and the circuit-breaking rod which has been moved to the second electrode due to the cutoff of the narrow portions caused by the explosion of the detonator.

BRIEF DESCRIPTION OF THE DRAWINGS

FIG. 3(*b*) is a side view of an operation-indicating rod;

FIG. 3(*c*) is a cross sectional view of the second electrode and the operation-indicating rod when assembled together;

DETAILED DESCRIPTION OF PREFERRED EMBODIMENTS

Figure 1:
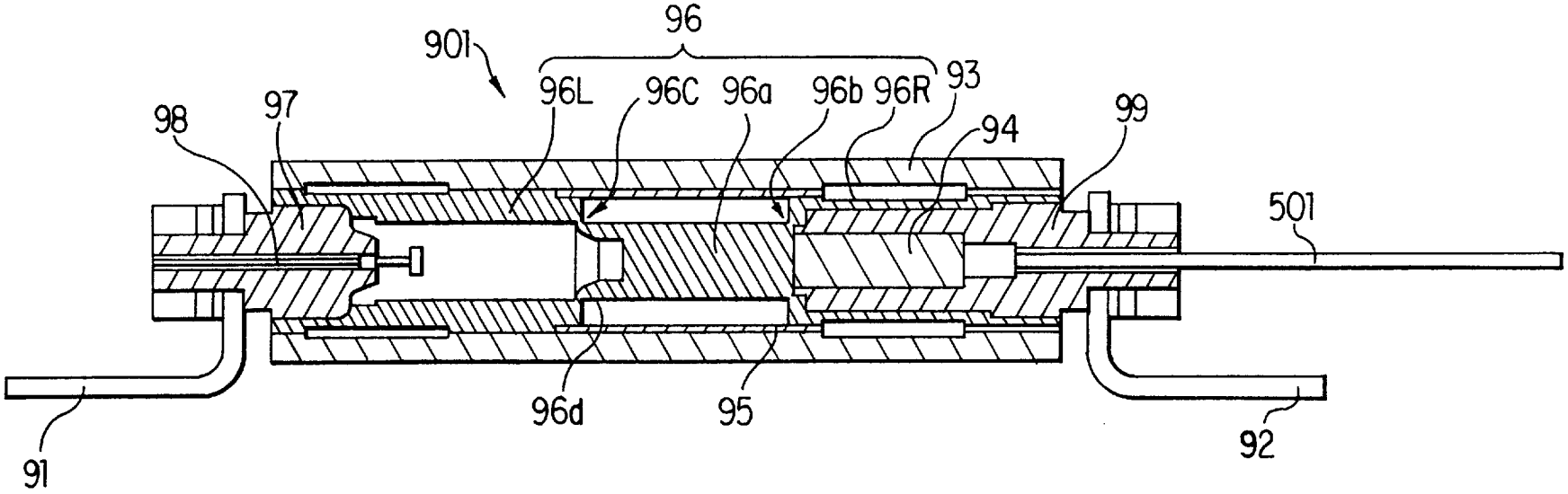
FIG. 1 is a vertical cross sectional view of a circuit-breaking apparatus before a circuit-breaking operation in a first embodiment of the invention.
Figure 7:
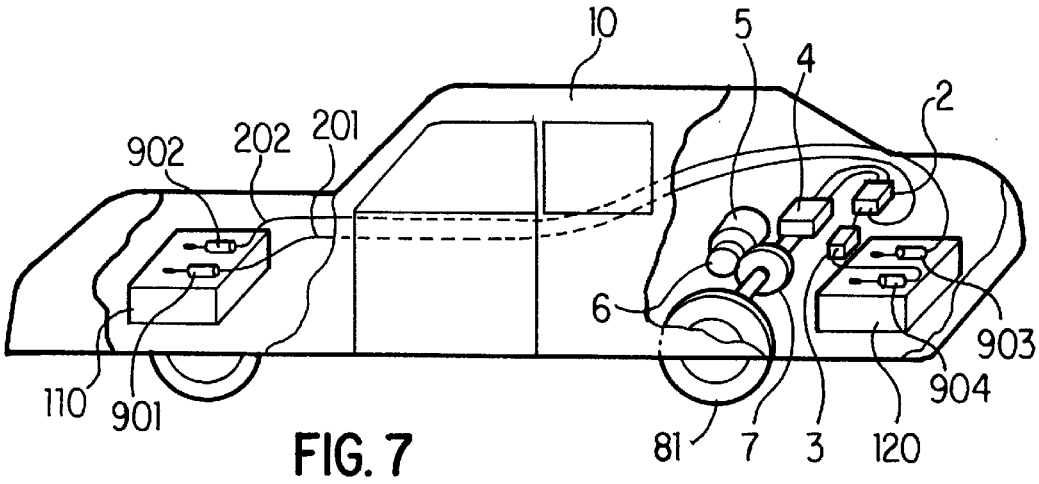
FIG. 7 is an explanatory view of an electric car and its drive system.

The invention is described below with reference to embodiments. FIG. 1 is a vertical cross sectional view of a circuit-breaking apparatus or current cut-out device showing a first embodiment of the invention. The circuit-breaking apparatuses 901, 902, 903, 904 in FIG. 7 all have the same structure, so the circuit-breaking apparatus 901 is only described.

In this figure, the circuit-breaking apparatus 901 comprises an insulating cylinder 93, a conductor 96 housed in the insulating cylinder 93, and two electrodes 97, 99 electrically and mechanically fixed to both sides of the conductor 96. The conductor 96 has a circuit-breaking rod 96*a* in a middle, a barrel section or barrel 96L located at the left of the circuit-breaking rod 96*a*, and a fixed portion 96R located at the right thereof. The circuit-breaking rod 96*a* can pass through the barrel 96L. The fixed portion 96R has a threaded portion described below, into which the first electrode 99 is screwed and fixed, and the barrel 96L also has at its left end a threaded portion, into which the second electrode 97 is screwed and fixed.

A connecting portion between the circuit-breaking rod 96*a* and the fixed portion 96R is constricted or narrowed so as to form a narrow portion 96*b*, and a connecting portion between the circuit-breaking rod 96*a* and the barrel 96L is similarly constricted or narrowed to form a narrow portion 96*c*. The first electrode 99 has, at a side of the circuit-breaking rod 96*a*, a built-in detonator 94 in which an explosive is filled to explode by an electric current supplied via a lead 501. The second electrode 97 has a through hole along a central axis thereof, into which an operation-indicating rod 98 is inserted. A right-end head of the operation-indicating rod 98 protrudes into the barrel 96L, while a left end is flush with the end surface of the second electrode 97.

An arc-extinguishing insulating cylinder 95 is provided around the circuit-breaking rod 96*a* so as to contact an inner surface of the insulating cylinder 93. The second electrode 97 has a terminal 91 connected to an external circuit, and the first electrode 99 has a terminal 92.

Figure 2:
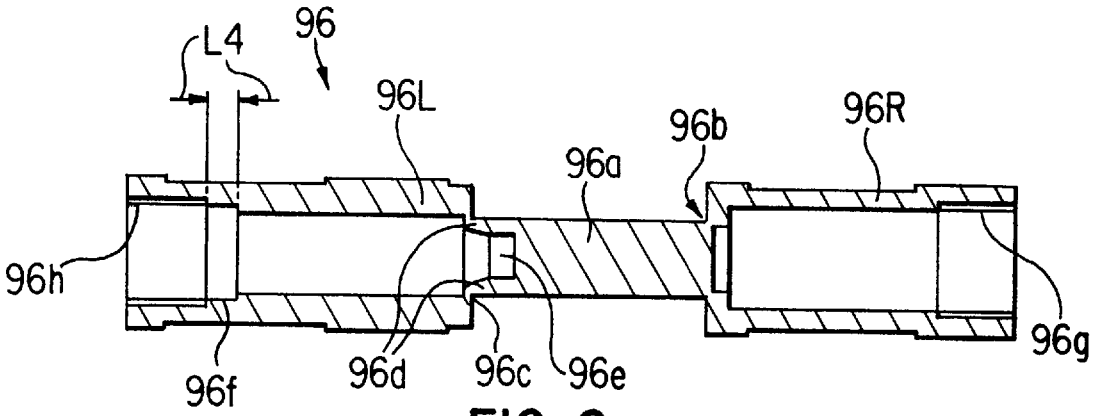
FIG. 2 is a cross sectional view of a conductor shown in FIG. 1.

FIG. 2 is a cross sectional view of the conductor shown in FIG. 1. In this figure, the conductor 96 comprises the barrel 96L on the left, the circuit-breaking rod 96*a* in the middle, and the fixed portion 96R on the right. The fixed portion 96R has a threaded portion 96*g* in which the first electrode 99 is mounted, and a hollow portion in which the detonator 94 is located. In the detonator, an explosive is filled and the lead 501 is introduced as described above.

The barrel 96L has a threaded portion 96*h* in which the second electrode 97 is mounted, and constitutes a cylinder with an inner diameter slightly larger than the outer diameter of the circuit-breaking rod 96*a*. The barrel 96L has, near its left tip and at the right of the threaded portion 96*h*, a large-diameter portion 96*f* which operates as a locking section and which has an inner diameter larger than the inner diameter of the barrel 96L so that a space enlarged outwardly is produced therein.

The circuit-breaking rod 96*a* is shaped like a round bar, and is connected to the fixed portion 96R via the narrow portion 96*b* and to the barrel 96L via the narrow portion 96*c*. The circuit-breaking rod 96*a* has at its left end a recess 96*e* and a protruding portion 96*d* surrounding the recess 96*e*. The recess 96*e* has a cross section shaped to fit the head of the operation-indicating rod 98 and the protruding portion of the electrode 97. Specifically, the recess 96*e* has a conical shape with a flat bottom surface. The axial dimension L4 of the large-diameter portion 96*f* is set so as to be almost the same as the axial dimension L5 (FIG. 3(*a*)) of the protruding portion of the second electrode 97 described below.

The conductor 96 may be formed by integrally uniting the barrel 96L, the circuit-breaking rod 96*a*, and the fixed portion 96R together, or these parts may be separately produced and connected together by means of brazing or diffusion bonding while the narrow portions 96*b*, 96*c* are simultaneously formed.

Figure 3A:
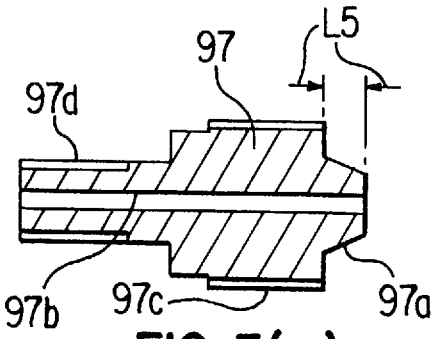
FIG. 3(*a*) is a cross sectional view of a second electrode.
Figure 3B:
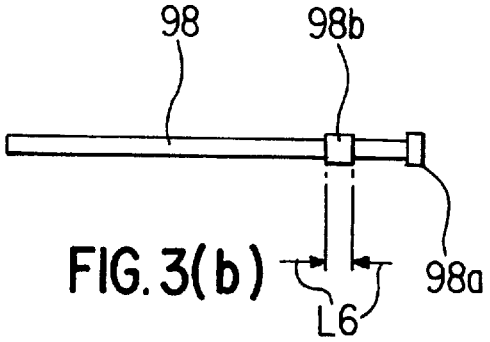
Figure 3C:
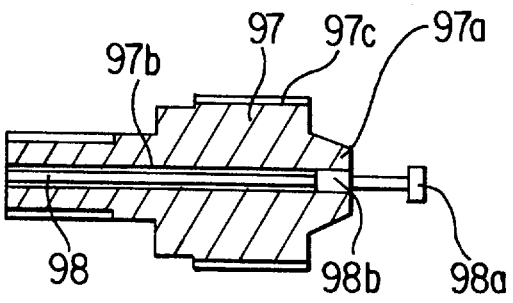

FIGS. 3(*a*)–3(*c*) show the second electrode 97 and the operation-indicating rod 98 penetrating the electrode 97, as shown in FIG. 1. FIG. 3(*a*) is a cross sectional view of the second electrode 97, FIG. 3(*b*) is a side view of the operation-indicating rod 98, and FIG. 3(*c*) is a cross sectional view of the second electrode and the operation-indicating rod when assembled together.

In these figures, the second electrode 97 has a through hole 97*b* along its central axis, and also has a screw section 97*c* screwed into the threaded portion 96*h* of the barrel 96L in the conductor 96 and a threaded section 97*d* on which the terminal 91 is mounted. The second electrode 97 has at its right end a protruding portion 97*a* with the same axial dimension and inclination as the conical portion of the recess 96*e* (see FIG. 2) of the conductor 96.

The operation-indicating rod 98 is formed of a material harder than the second electrode 97, and has two diameter portions. One diameter portion is slightly smaller than the inner diameter of the through hole 97*b* which allows easy insertion, and the other is a large-diameter portion 98*b* with a larger outer diameter. The operation-indicating rod 98 has at its right end a head 98*a* with a larger-diameter which contacts the bottom surface of the recess 96*e* of the conductor 96 when the circuit-breaking rod 96*a* is urged thereto.

The larger-diameter portion 98*b* of the operation-indicating rod 98 is produced by means of knurling, and is press-fitted in the through hole 97*b* with a smaller diameter. The presence of the large-diameter portion 98*b* causes the operation-indicating rod 98 to be held in position after press-fitting, so that the operation-indicating rod 98 is preventing from moving easily in the through hole 97*b*. Adequate press-fitting and retaining forces can be obtained by selecting appropriate values for the diameter and axial dimension L6 of the large-diameter portion 98*b*.

The circuit-breaking or current cut-out operation of the circuit breaking-apparatus shown in FIG. 1 is described below.

Figure 8:
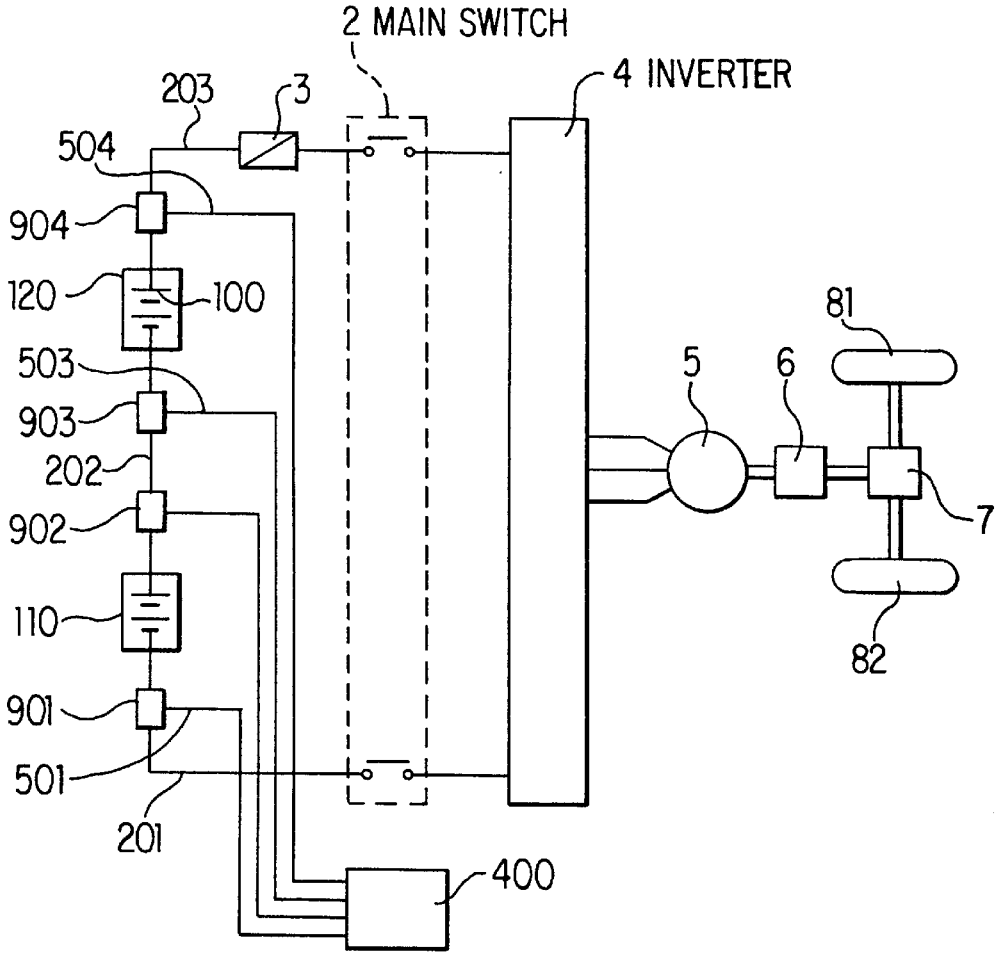
FIG. 8 is a circuit diagram of an electric circuit in FIG. 7.

If an impact sufficient to activate an air bag in an electric car occurs upon an accident, an output signal from the impact detector built in the controller 400 shown in FIG. 8 causes an electric current to flow to the detonator 94 via the lead 501, thereby exploding the explosive. The internal pressure of the detonator 94 increases rapidly by the explosion to generate a force that pushes the circuit-breaking rod 96*a* toward the second electrode 97. The narrow portions 96*b* and 96*c* are cut off by this force, thus releasing the circuit-breaking rod 96*a* to move through the barrel 96L and to hit the second electrode 97. Consequently, the conductor 96 is cut off at the circuit-breaking rod 96*a*, thereby eliminating the current path and interrupting the electric current passing through the conductor 96.

Figure 4:
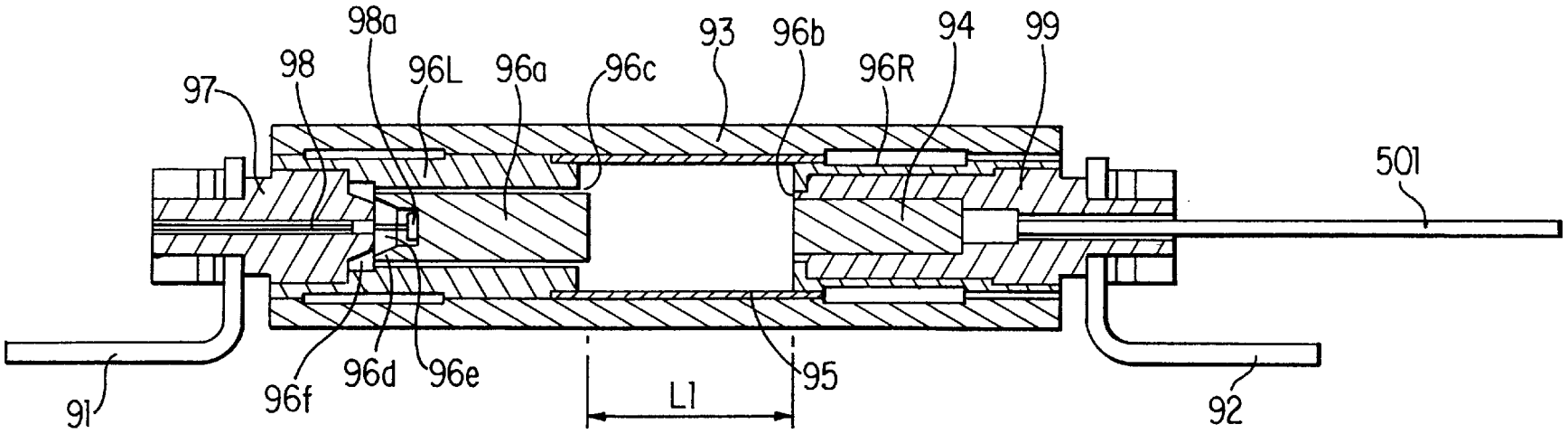
FIG. 4 is a vertical cross sectional view of the circuit-breaking apparatus in FIG. 1 at a moment of a circuit-breaking operation.

FIG. 4 is a vertical cross sectional view of the circuit-breaking apparatus at the moment when the bottom surface of the recess 96*e* of the conductor 96 contacts the head 98*a* of the operation-indicating rod 98. In this figure, the distance L1 between the left end surfaces of the first electrode 99 and the fixed portion 96R, and the right end surface of the circuit-breaking rod 96*a* is set at a value larger than the insulating distance required therebetween. Due to the presence of the large-diameter portion 98*b* as described above, a large force is required to move the operation-indicating rod 98 by the circuit-breaking rod 96*a* from the position shown in this figure until the left end of the rod 98 protrudes from the second electrode 97. As described above, the dimension L1 is large enough not to cause insulation breakdown between the first electrode 99 and the circuit-breaking rod 96*a* to prevent failure of the circuit-breaking function even if the operation-indicating rod 98 is not pushed enough by failure and the circuit-breaking rod 96*a* remains in the position shown in FIG. 4.

Figure 5:
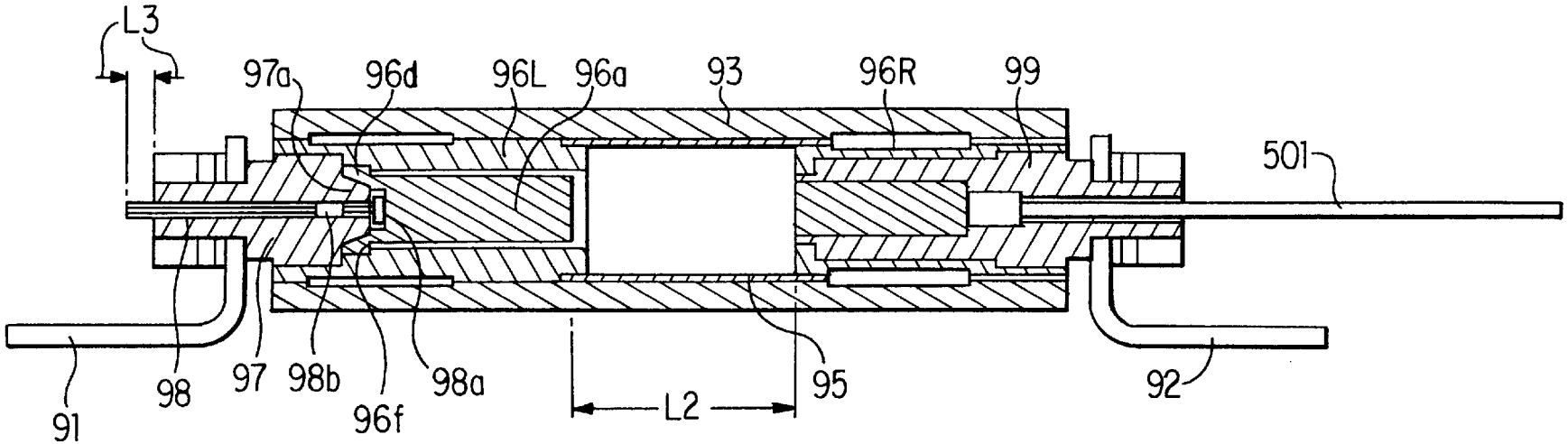
FIG. 5 is a vertical cross sectional view of the circuit-breaking apparatus in FIG. 1 after the circuit-breaking operation has been completed.

FIG. 5 is a vertical cross sectional view of the circuit-breaking apparatus after the circuit-breaking operation has been completed. The circuit-breaking rod 96*a* is moved further from the position shown in FIG. 4 so as to push the operation-indicating rod 98 in such a way that the left end protrudes as shown in the figure. Due to the large-diameter portion 98*b* described above, the operation-indicating rod 98 is held in position once it protrudes from the second electrode. Thus, it is possible to visually confirm whether the circuit-breaking apparatus has performed its circuit-breaking function. In addition, a very large force is applied to the circuit-breaking rod 96*a* in order to press and move the operation-indicating rod 98 leftwardly. Therefore, after the circuit-breaking rod 96*a* hits the second electrode 97, its protruding portion 96*d* is plastically deformed when it is pressed against the large-diameter portion 96*f*, and then enters into the portion 96*f*. As a result, even after the pressure has been eliminated, the plastically deformed portion serves as a stopper for holding the circuit-breaking rod 96*a* in contact with the second electrode 97. This prevents the circuit-breaking rod 96*a* from returning to its original position by any reason to re-form a conductive path.

In case an electric current is flowing through the narrow sections 96*b* and 96*c* when the narrow sections are cut off and the circuit-breaking rod 96*a* starts moving leftwardly, an arc may be generated in the gap at the narrow portion 96*b* which has been formed when it has been cut off. This arc is usually cut off and extinguished due to the rapid movement of the circuit-breaking rod 96*a* in order to complete the circuit-breaking action, but extinction of the arc may be difficult if a large electric current, such as a short-circuit current, is present. In view of this point, an arc-extinguishing insulating cylinder 95 is provided to improve the arc-extinguishing performance.

A material for the arc-extinguishing insulating cylinder 95 should have good circuit-breaking characteristics and be able to sufficiently maintain the insulating characteristic after circuit-breaking. Also, the material should possess a large ratio of hydrogen to carbon in the decomposed gas that has been generated by thermal decomposion of the material, so that a large amount of hydrogen gas is generated upon circuit-breaking to thus effectively cool the arc for extinction. Furthermore, decomposed gas without a benzene derivative is effective in maintaining insulation resistance after the circuit-breaking, and polyacetal resin is suitable for the material. The materials, however, are not limited to these resins. The arc-extinguishing insulating cylinder 95 also serves to protect the insulating cylinder 93.

Figure 6:
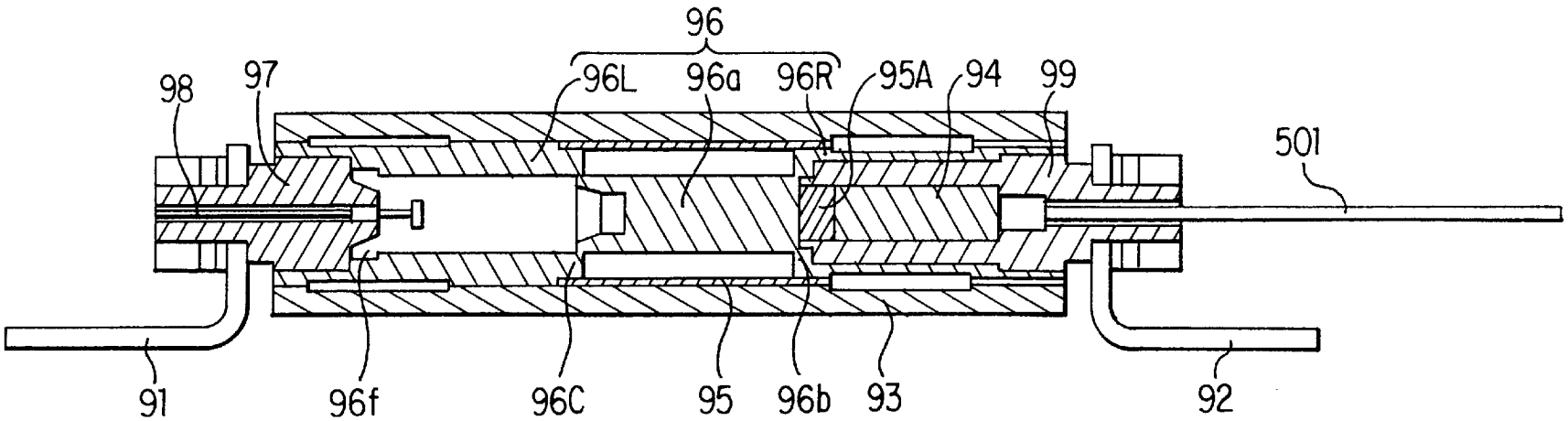
FIG. 6 is a vertical cross sectional view of a circuit-breaking apparatus for showing a second embodiment of the invention.

FIG. 6 is a cross sectional view of the circuit-breaking apparatus showing a second embodiment of the invention. This embodiment differs from the first embodiment in that an arc-extinguishing material 95A is located at the end of the detonator 94. When the explosive is exploded, the narrow portions 96*b* and 96*c* are cut off to move the circuit-breaking rod 96*a*, causing an arc to generate. The arc then impinges on the arc-extinguishing material 95A to generate gas, which cools and extinguishes the arc rapidly. The arc-extinguishing material 95A is preferably a polyacetal resin powder suitable for the above arc-extinguishing insulating cylinder 95, but other materials are also suitable.

Although the structure other than the arrangement in FIG. 6, which relates to the arc-extinguishing material 95A, has been described in the first embodiment, the structures including the installation of the operation-indicating rod 98, the arc-extinguishing cylinder 95 and the large-diameter portion 96*f* for retaining the position of the circuit-breaking rod 96*a* by using plastic deformation need not be necessarily incorporated in the circuit-breaking apparatus. That is, if one or more of these elements is applied to the circuit-breaking apparatus, such element or elements will produce the respective effects. Consequently, four items including the installation of the arc-extinguishing material 95A may be applied to the actual circuit-breaking apparatus by combining them as appropriate.

As described above, according to the first aspect of the circuit-breaking apparatus of the invention, since the locking section in the barrel ensures the locking of the circuit-breaking rod that has been shifted to the second electrode, the circuit-breaking condition can be reliably maintained without subsequent movement of the circuit-breaking rod. In the second aspect of the invention, the protruding portion at the end of the circuit-breaking rod is plastically deformed and enters into the large-diameter portion provided in the barrel. The portion that the circuit-breaking rod has entered acts as a stopper to lock the rod.

According to the third aspect of the circuit-breaking apparatus, at the time of circuit-breaking, if an arc is generated when the circuit-breaking rod is shifted, the arc is reliably extinguished, because the arc is cooled by decomposed gas generated when the arc contacts the arc-extinguishing cylinder or the arc-extinguishing material.

According to the fourth aspect of the circuit-breaking apparatus, at the time of circuit-breaking, since the circuit-breaking rod contacts the operation-indicating rod to protrude the operation-indicating rod externally from the second electrode, this protrusion can be externally seen to easily confirm whether or not a circuit-breaking operation has been performed. In addition, since the operation-indicating rod is press-fitted into the electrode, it is prevented from being moved easily either before or after a circuit-breaking operation, so that an error in confirming whether a circuit-breaking operation has been performed is prevented.

Furthermore, since the moving distance of the circuit-breaking rod until it contacts the operation-indicating rod is set so as to be longer than the insulating distance required between the circuit-breaking rod and the first electrode, even if the circuit-breaking rod stops at that position, the required insulating strength is ensured to perform the reliable circuit-breaking function.

What is claimed is:

1. A circuit-breaking apparatus comprising:

an insulating housing, first and second electrodes located at two lateral ends of the insulating housing, a detonator located in the first electrode and having an explosive therein, a lead connected to the detonator for supplying an electric current to the detonator when the detonator is to be actuated, and a conductor disposed in the insulating housing and including a fixed portion electrically connected to the first electrode, a circuit-breaking rod having narrow portions at two lateral ends and a protruding portion adjacent to one of the narrow portions, and a barrel connected to the second electrode and having a cavity, said circuit-breaking rod being coupled to the fixed portion through the narrow portion at one lateral end and the barrel through the protruding portion and the narrow portion at the other lateral end, said barrel having a locking section for locking in the cavity the circuit-breaking rod that has been shifted toward the second electrode due to cutoff of the narrow portions caused by the explosion of the detonator, said locking section being a large-diameter portion provided in the cavity near the second electrode so that the protruding portion of the circuit-breaking rod that has been shifted to the second electrode due to the explosion of the detonator is plastically deformed by colliding against the second electrode and is enlarged to lock in the large-diameter portion to thereby prevent re-connection between the first and second electrodes.

2. A circuit-breaking apparatus according to claim 1, wherein said locking section of the barrel is a large-diameter portion provided in the cavity near the second electrode so that a part of the circuit-breaking rod that has been shifted to the second electrode due to the explosion of the detonator is plastically deformed by colliding against the second electrode and locked in the large-diameter portion.

3. A circuit-breaking apparatus according to claim 1, further comprising an arc-extinguishing insulating cylinder formed of a material that generates decomposed gas when subjected to an arc generated at a time of circuit-breaking, said arc-extinguishing cylinder being provided near one of the narrow portions for connecting the circuit-breaking rod and the fixed portion.

4. A circuit-breaking apparatus according to claim 3, wherein said arc-extinguishing insulating cylinder extends between the fixed portion and the barrel around the circuit-breaking rod.

5. A circuit-breaking apparatus according to claim 1, further comprising an arc-extinguishing material provided near one of the narrow portions for connecting the circuit-breaking rod and the fixed portion.

6. A circuit-breaking apparatus according to claim 5, wherein said arc-extinguishing material is provided on the detonator at a side of the circuit-breaking rod.

7. A circuit-breaking apparatus according to claim 1, wherein said circuit-breaking rod has a recess inside the protruding portion, and said second electrode has a protruding portion facing the recess so that when the protruding portion of the circuit-breaking rod hits the protruding portion of the second electrode, the protruding portion of the circuit-breaking rod is enlarged to enter the large-diameter portion.

8. A circuit-breaking apparatus according to claim 7, wherein said recess and the protruding portion of the second electrode have conical shapes similar to each other.

9. A circuit-breaking apparatus comprising:

an insulating housing, first and second electrodes located at two lateral ends of the insulating housing, a detonator located in the first electrode and having an explosive therein, a lead connected to the detonator for supplying an electric current to the detonator when the detonator is to be actuated, a conductor disposed in the insulating housing and including a fixed portion electrically connected to the first electrode, a circuit-breaking rod having narrow portions at two lateral ends thereof, and a barrel connected to the second electrode and having a cavity, said circuit-breaking rod being coupled to the fixed portion and the barrel through the narrow portions, said barrel having a locking section for locking in the cavity the circuit-breaking rod that has been shifted toward the second electrode due to cutoff of the narrow portions caused by the explosion of the detonator to thereby prevent re-connection between the first and second electrodes, and an operation-indicating rod movably disposed in the second electrode and having one end to be pushed by the circuit-breaking rod and the other end to be protruded outside the second electrode when the detonator is exploded, a distance that the circuit-breaking rod moves until the circuit-breaking rod contacts the operation-indicating rod being longer than a distance required to insulate the circuit-breaking rod from the first electrode.

10. A circuit-breaking apparatus according to claim 9, wherein said operation-indicating rod includes a large diameter portion to restrict movement thereof in the second electrode.

* * * * *